US005438803A

United States Patent [19]

Blizard, Jr.

[11] Patent Number: 5,438,803

[45] Date of Patent: Aug. 8, 1995

[54] RAIN GUTTER GUARD

[75] Inventor: George L. Blizard, Jr., Moorestown, N.J.

[73] Assignee: Blizard Associates, Inc., Moorestown, N.J.

[21] Appl. No.: 144,790

[22] Filed: Oct. 29, 1993

[51] Int. Cl.[6] ..... E04D 13/00

[52] U.S. Cl. ..... 52/12; 210/474

[58] Field of Search ..... 52/11, 12; 210/474

[56] References Cited

U.S. PATENT DOCUMENTS

| | | | |
|---|---|---|---|
| 453,948 | 6/1891 | Smith et al. | 52/12 |
| 870,165 | 11/1907 | Hagler et al. | 52/12 |
| 1,349,264 | 8/1920 | Busse | 210/474 |
| 2,175,521 | 10/1939 | Fry | 52/12 |
| 2,209,741 | 7/1940 | Sullivan et al. | 52/12 |
| 2,365,845 | 12/1944 | Schweda | 52/12 |
| 2,526,271 | 10/1950 | Probst . | |
| 2,636,458 | 4/1953 | Harris | 52/12 X |
| 2,988,226 | 6/1961 | Campbell | 210/474 |
| 3,550,381 | 12/1970 | South . | |
| 3,977,135 | 8/1976 | Hunley, Jr. | 210/474 |
| 4,032,456 | 6/1977 | Berce | 52/12 X |
| 4,190,988 | 3/1980 | Carreiro | 52/11 |
| 4,727,689 | 3/1988 | Bosler | 52/12 |
| 4,841,686 | 6/1989 | Rees | 52/12 |
| 4,888,920 | 12/1989 | Marulic | 52/12 |
| 4,907,381 | 3/1990 | Ealer | 52/12 |
| 4,912,888 | 4/1980 | Martin | 52/12 |
| 4,936,061 | 6/1990 | Palma | 52/12 |
| 4,949,514 | 8/1990 | Weller | 52/12 |
| 4,959,932 | 10/1990 | Pfeifer | 52/12 |
| 5,040,750 | 8/1991 | Brant | 52/12 |
| 5,095,666 | 3/1992 | Williams, Jr. | 52/11 |

FOREIGN PATENT DOCUMENTS

| | | | |
|---|---|---|---|
| 4116219 | 11/1992 | Germany | 52/12 |

*Primary Examiner*—Carl D. Friedman
*Assistant Examiner*—W. Yip
*Attorney, Agent, or Firm*—Austin R. Miller

[57] ABSTRACT

A guard for the protection of rain gutters includes a solid back portion scored along a score line, which is bent to secure the guard to a gutter. A pivoting means lifts the gutter guard; a solid front portion is affixed with a pressure sensitive adhesive for securing to the gutter and is pivotable for allowing access therein. The guard has a middle portion having holes sized to allow the passage of water while substantially retaining solid materials.

9 Claims, 4 Drawing Sheets

*Fig. 3*
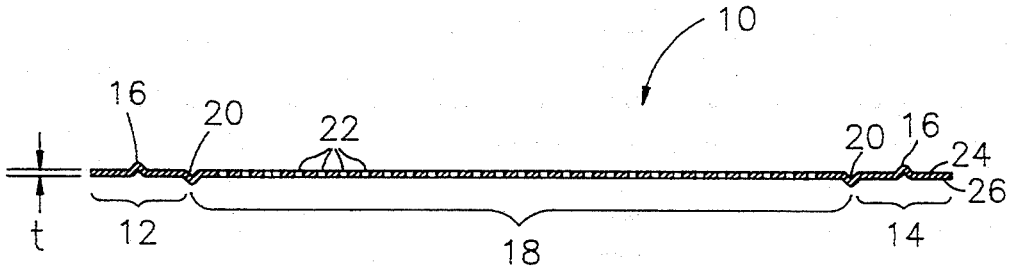
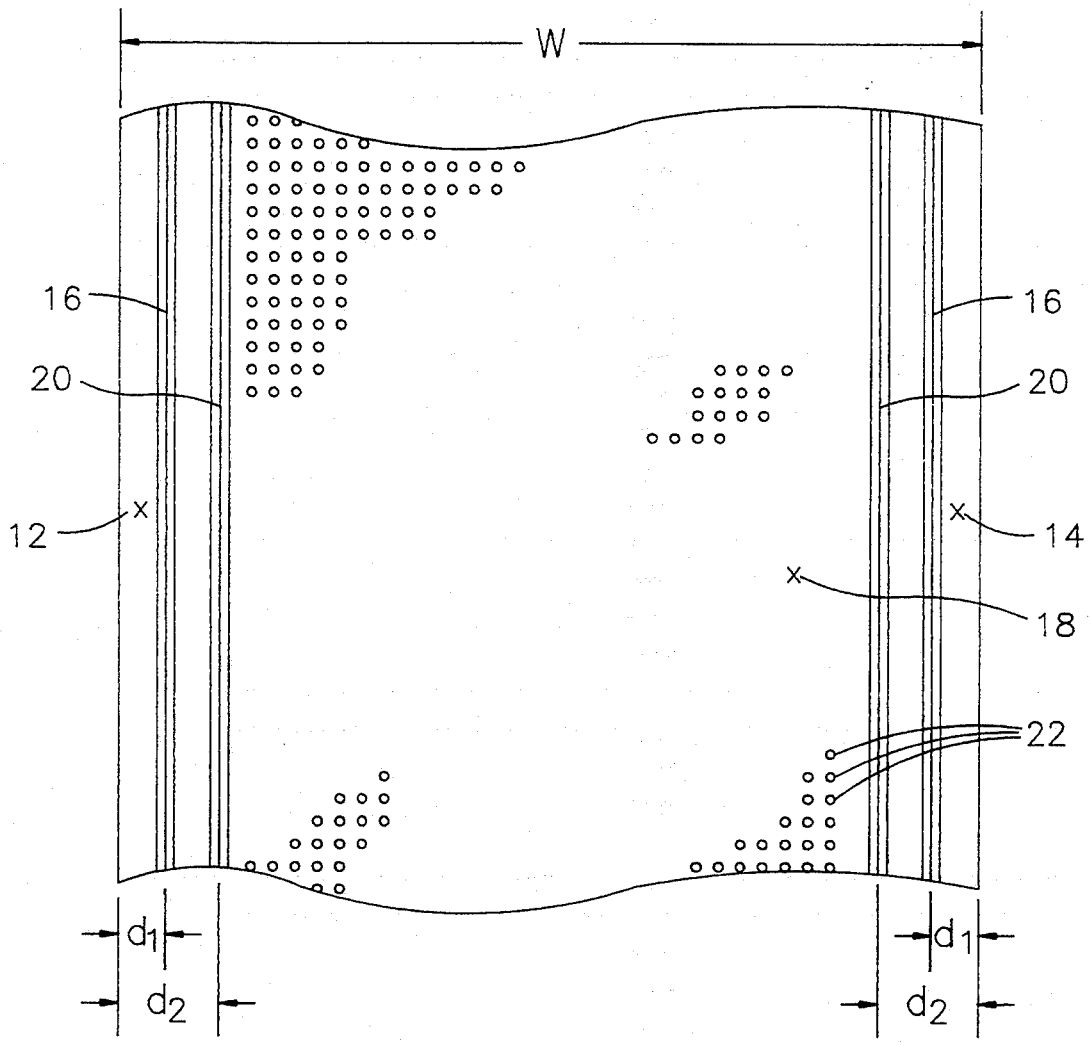
*Fig. 4*

RAIN GUTTER GUARD

BACKGROUND OF THE INVENTION

1. Field of the Invention

The present invention relates to drain shields for rain gutters in the form of a screen and support structure placed atop the gutter to prevent leaves and other debris from impairing proper operation of the rain gutter.

2. Description of the Prior Art

Many different designs for the protection of rain gutter operation are disclosed in the prior art. These designs are inadequate because they are too complex and too costly, or provide poor accessibility to the gutter assembly for cleaning.

U.S. Pat. No. 4,959,932 discloses a rain gutter screen in the form of a laminate of two or more sheets of various types of mesh, a leading edge of the screen, composed of a bondable, flexible material, to be placed beneath the end shingles of a roof and a means for attaching the discharge end of the screen to the inside and outside edge of a cave gutter. However, the device of '932 is cumbersome to install, requiring the raising of the end roof shingles to secure the device, which then must be permanently bonded to the roof top. Additionally, the device has the distinct disadvantage that a support screen must be placed inside the screen mesh which increases the complexity of the device and increases cost.

U.S. Pat. No. 4,841,686 discloses a filter attachment to fit over the open end of a gutter which includes an elongated screen to which is added a pad of fibrous glass material which must be clamped to the underside thereof, increasing cost. Additionally, the device requires adjustable clamps for holding the filter in place on the gutter opening. U.S. '686 is directed toward providing a gutter screen which cannot be opened for cleaning of the gutter. The design of the device increases the difficulty in accessing the inside of the gutter assembly to clear away debris which is not retained by the filter.

U.S. Pat. No. 3,977,135 discloses a gutter screen which is affixed with hinges that are spring loaded to keep the screen against the gutter until it is desired to open the screen to remove debris therefrom. This device is complex and cumbersome in design, increasing the cost of the device as well as the cost of installation. Additionally, removal of the device from the gutter assembly is burdensome, since the hinges are permanently fastened to the gutter itself.

Other prior art references such as U.S. Pat. Nos. 5,095,666, 5,040,750, 4,907,381, and 4,888,920 all disclose various cumbersome and costly means of fastening a gutter protection device to the top of the gutter using a variety of permanent clamps and other fasteners, which increase the cost of installation and increase the difficulty in accessing the inside of the gutter for the cleaning of debris not retained by the protection device.

Furthermore, many conventional gutter protection devices are mounted inside the gutters and tend to be deformed and pushed down into the area near the bottom of the gutter, due to the weight of leaves and other debris retained by the device. This makes it difficult to clean the gutters, or even to remove the deformed screens.

Finally, gutter protection devices formed from polymeric materials tend to soften and sag when heated by direct sunlight. This problem is exacerbated by the weight of debris on the softened surface.

SUMMARY OF THE INVENTION

It is an object of this invention to provide solutions to the problems associated with conventional gutter protection devices. Specifically, the primary objective of this invention is to provide an improved rain gutter guard which is easy to clean and has increased strength and resistance to damage, while reducing cost and maintenance requirements.

Another object of this invention is to provide a rain gutter guard that allows easy access for removing debris from the inside of the gutter.

Other objects and advantages of this invention will further appear hereinafter and in the drawings.

BRIEF DESCRIPTION OF THE DRAWINGS

FIG. 3 is a cross-sectional side view of another gutter guard according to this invention.

FIG. 4 is a top view of a section of the gutter guard shown in FIG. 3.

DETAILED DESCRIPTION OF THE PREFERRED EMBODIMENT

The following description of the preferred embodiments is meant for the purpose of illustration only and is no way meant to limit the invention in spirit or scope as defined in the appended claims.

The rain gutter guard is installed atop the rain gutter assembly by bending the solid back portion of the guard along a score line to form a flap. This flap is secured by means of a pressure sensitive adhesive to the back of the gutter assembly. The pressure sensitive adhesive is an important feature of this invention in that it strongly secures the flap in place but allows for its removal from the rain gutter for the purpose of cleaning or otherwise. The solid front portion of the guard is affixed by means of a pressure sensitive adhesive to the front of the gutter assembly. The gutter guard portion intermediate the front and back portions is provided with gaps which allow for the passage of water while retaining leaves and other debris.

Figure 1:
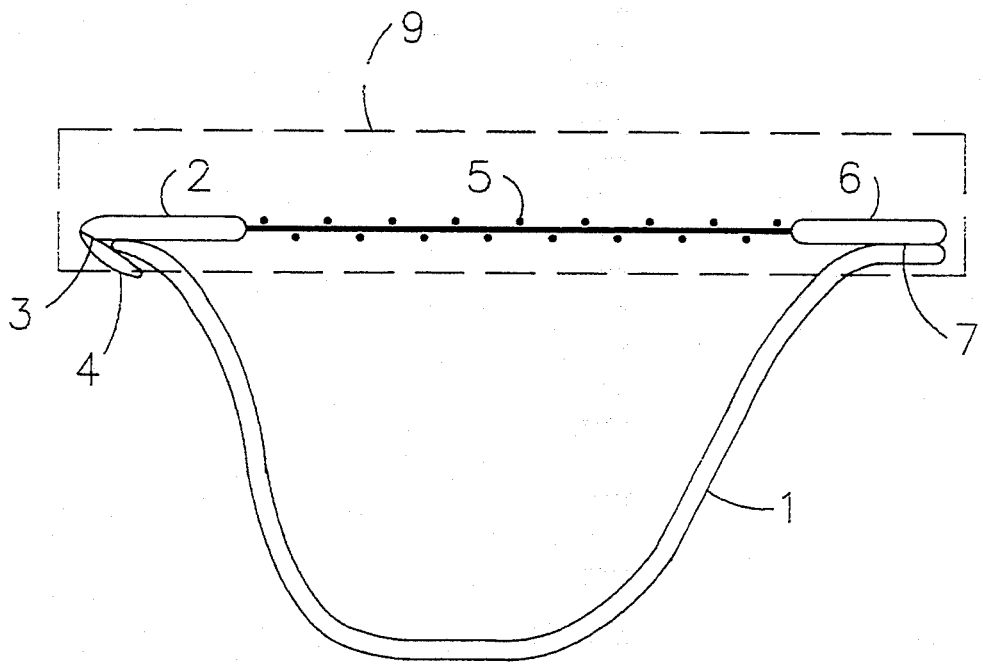
FIG. 1 is a cross-sectional side view of an embodiment of the gutter guard according to this invention.

Referring to FIG. 1, gutter assembly 1 is covered by rain gutter guard 9. Back portion 2 is scored along score line 3 and bent over the back edge of gutter assembly 1, forming flap 4 which secures the back portion of the gutter guard to the gutter assembly. Screen 5 is connected between back portion 2 and front portion 6 to provide for the passage of water into gutter assembly 1 and the retention of leaves and other debris. Front portion 6 is affixed with pressure sensitive adhesive strip 7, which advantageously secures the front portion of gutter guard 9 to gutter assembly 1 but allows upward removal of the gutter guard thereby allowing for easy access to the inside of gutter assembly 1 for cleaning.

The gutter guard may be composed of traditional materials, which includes vinyl polymer or metals such as aluminum or steel, but is not limited thereto. When it is configured in roll form, it may have, for example, a thickness of about 0.016" (26 gage) or when used as a stamped product it may have a thickness of about 0.020" (24 gage). These thicknesses are not critical but typically provide sufficient flexibility for easy installation and use while still providing enough strength to support the weight of animals, such as squirrels without excessive deformation.

Back portion 2, score line 3 and flap 4 form a pivoting member which allows gutter guard 9 to be opened by lifting front portion 6 and separating pressure sensitive adhesive strip 7 from gutter assembly 1. After the cleaning of leaves and other debris from screen 5 and the inside of gutter assembly 1, gutter guard 9 can then be closed and re-sealed. Front portion 6 is pressed back against gutter assembly 1 and pressure sensitive adhesive strip 7 affixes it thereto.

Figure 2:
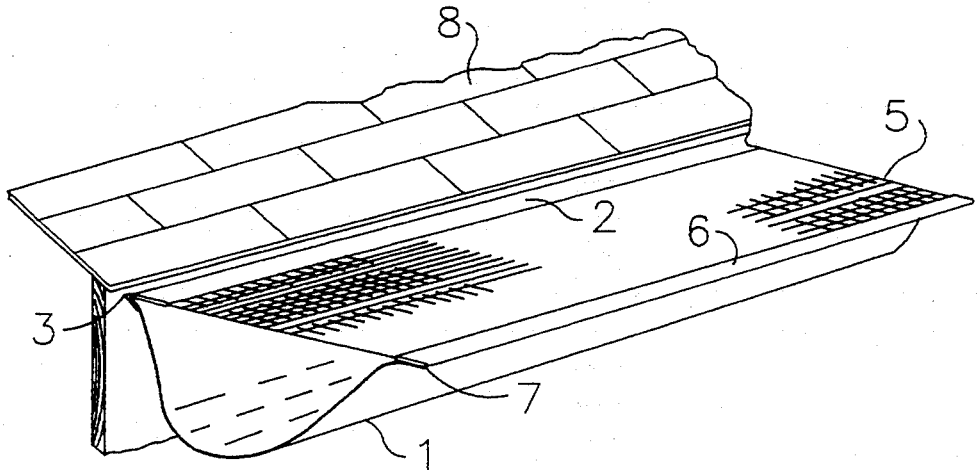
FIG. 2 is a front perspective view of the embodiment of the gutter guard shown in FIG. 1 mounted on a gutter assembly.

FIG. 2 shows a from perspective of an installed gutter assembly utilizing a preferred form of rain gutter guard of the present invention. Gutter assembly 1 is mounted just below the edge of roof 8, in a conventional manner, such as by hooks fastened below the roofline, not shown. Leaves and debris collect on screen 5, as water passes into gutter assembly 1 to be drained off.

The embodiment of the gutter guard invention shown in FIGS. 3 and 4, generally designated 10, has a one-piece construction formed from a unitary strip of metallic or other material. Gutter guard 10 has edge portions 12 and 14 provided with upward score lines 16 along which edge portions are easily folded. Downward score lines 20 separate end portions 12 and 14 from central portion 18. Central portion 18 has a plurality of perforations 22 adapted to allow for the flow of rain water while preventing the passage of leaves and other debris. Gutter guard 10 has a top surface 24, a bottom surface 26, and a thickness controlled so that gutter guard 10 remains flexible but resists deformation due to the weight of foreign objects or of animals such as squirrels. Bottom surface 26 of gutter guard 10 is coated with pressure sensitive adhesive. The adhesive is optionally provided only on edge portions 12 and 14 but may be provided along the entire bottom surface 26 of gutter guard 10, including bottom surface 26 of central portion 18. The presence of pressure sensitive adhesive is an important and advantageous feature of the invention, as previously discussed.

Referring to FIG. 4, gutter guard 10 has a width w and may be provided in a variety of sizes. Width w is preferably approximately 6 inches for residential gutters, and gutter guard 10 may optionally be supplied in long, coiled lengths of predetermined length or of greater length to be cut to size upon installation. Score lines 16 in edge portions 12 and 14, and score lines 20 defining the boundary of edge portions 12 and 14, are located at distances $d_1$ and $d_2$ from the edges of gutter guard 10, respectively. Distance $d_1$ is preferably about half of distance $d_2$, thereby bisecting edge portions 12 and 14. Distance $d_1$ is preferably about 5/16", and distance $d_2$ is preferably about ⅝" but these dimensions are not critical.

Figure 5:
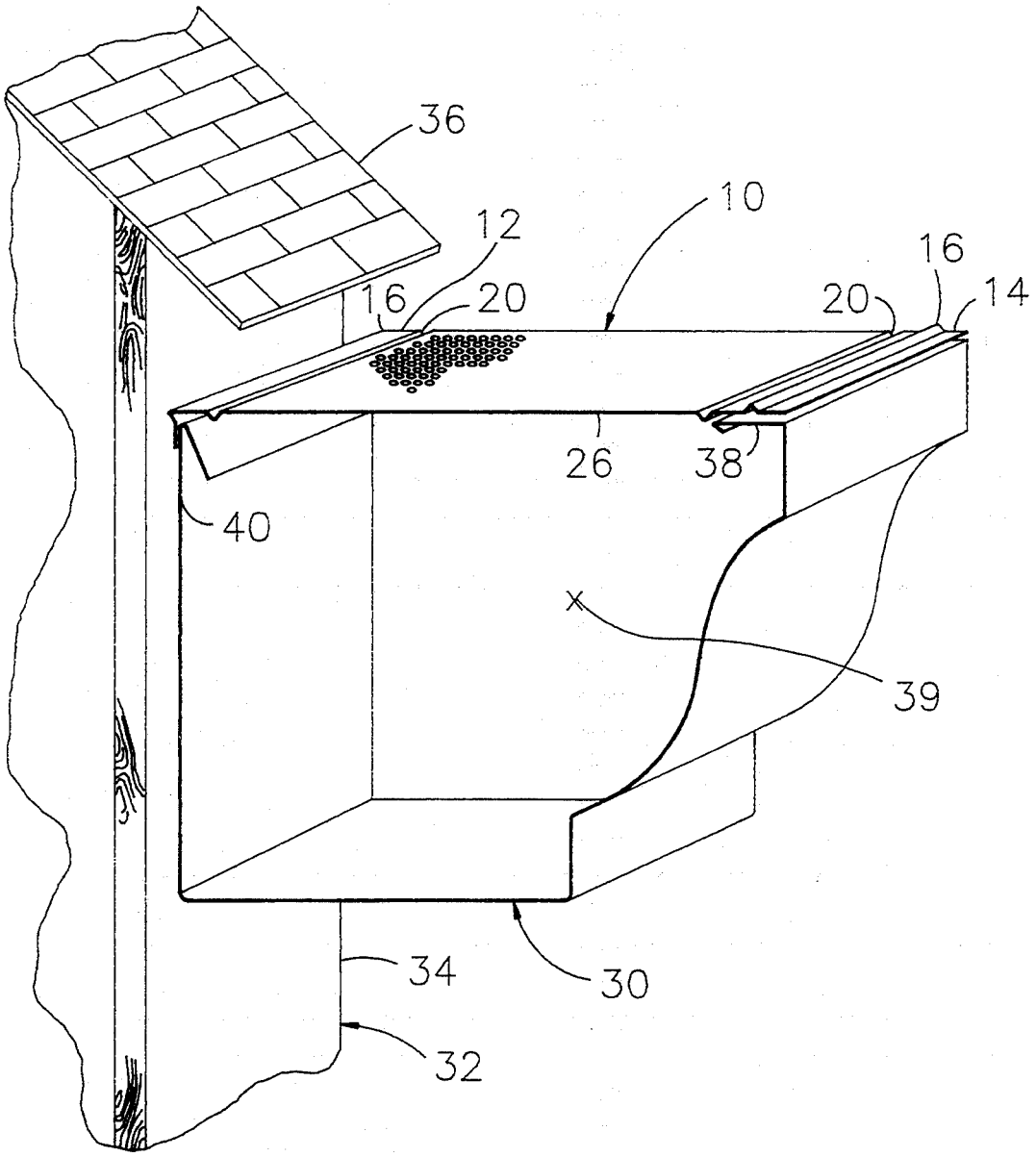
FIG. 5 is a perspective view of the gutter guard shown in FIGS. 3 and 4 mounted on a gutter assembly.

In FIG. 5, gutter guard 10 is shown mounted on gutter assembly 30 attached to a structure 32 having a wall 34 and a roof 36. Gutter assembly 30 has a ledge portion 38 and is provided with a standard cross-sectional shape to define an interior area 39. Bottom surface 26 of gutter guard 10, provided with pressure sensitive adhesive, is applied to ledge portion 38 to adhere edge portion 14 to gutter assembly 30. Edge portion 12 is folded along score line 16, and pressure sensitive adhesive on bottom surface 26 adheres edge portion 12 to gutter assembly wall 40.

In operation, edge portion 14 may be lifted from ledge 38 and gutter guard 10 may be flexed about score lines 16 and 20 to expose the interior 39 of gutter assembly 30. Accordingly, access is provided to the interior 39 so that debris in gutter assembly 30 can be removed. Subsequently, the pressure sensitive adhesive on bottom surface 26 of end portion 14 may be re-applied to ledge 38 of gutter assembly 30, thereby closing gutter guard 10. Gutter guard 10 can be mounted on standard residential or commercial gutters having various dimensions.

Installation of gutter guard 10 is possible whether roofing or roof flashing enters the gutter or not. When roofing or roof flashing enters the gutter, edge portion 12, which would otherwise be adhered to wall 40 of gutter assembly 30, is folded against itself along score line 16 and leaned against the roofing or roof flashing surface. In such an installation, edge portion 14 remains adhered to ledge 38, and edge portion 12 is lifted to flex gutter guard 10 about score lines 16 and 20 to provide access to interior region 39.

This simplified design provides the great benefit of increased accessibility and ease of cleaning, while reducing the cost and complexity of traditional gutter protection devices, which are secured with clamps, screws and other fasteners. A gutter guard constructed in accordance with the present invention also provides the great benefit of increased structural strength in addition to improving accessibility and ease of cleaning and reducing the cost of the gutter guard. This is achieved by attaching the gutter guard to the top of the gutter assembly and not within as in previous gutter guards. This increases the structural support of the guard so that it can withstand greater force, such as the weight of squirrels, for example.

Finally, a gutter guard according to this invention is easy and safe to install, replace and clean. Not only does the gutter guard minimize the time spent on ladders associated with cleaning and installing of conventional gutter screens, but the ease of handling reduces the occurrence of scratches and cuts.

Although the present invention has been described in a specific embodiment thereof, it is not limited thereto in spirit or in scope, as defined in the appended claims.

What is claimed is:

1. A gutter guard adapted to be secured on top of a rain gutter, said gutter guard comprising:

a rear portion which includes a curved portion arranged to secure said gutter guard to a rear wall of said rain gutter, said curved portion being shaped to provide a pivoting means for pivoting said gutter guard relative to said gutter;

a front portion adapted to extend over a front wall of said gutter, said front portion having a pressure-sensitive adhesive on a bottom surface thereof, said front portion being adapted for attachment to said gutter in a closed position and said front portion being adapted for release from said gutter in an open position to allow access to said gutter; and an intermediate portion extending between said rear portion and said front portion and provided with openings sized to allow the passage of water while substantially retaining leaves and solid material.

2. The gutter guard defined in claim 1, wherein said intermediate portion is composed of wire mesh.

3. A screen secured to a gutter, said gutter having longitudinally extending walls defining an interior gutter region, said screen having a closed position relative to said gutter for preventing the flow of debris into said interior gutter region and having an open position relative to said gutter to provide access to said interior gutter region, said screen comprising:

two spaced-apart edge portions, at least one having pivoting means and at least one having pressure sensitive adhesive on a bottom surface, each of said edge portions contacting a top surface of one of the opposing walls of said gutter when in said closed position; and said screen having an intermediate portion separating said edge portions and having passages to permit water to flow into said interior gutter region while preventing entry of debris into said interior gutter region.

4. The screen of claim 3, wherein said pivoting means includes one or more longitudinally extending score lines about which an edge portion is bent.

5. The screen of claim 4, wherein said score lines bisect both of said edge portions and separate each said edge portion from said intermediate portion.

6. The screen of claim 3 formed from a single sheet of material.

7. The screen of claim 6, wherein said passages comprise a multiplicity of perforations in said sheet.

8. The screen of claim 3, wherein said intermediate portion comprises wire mesh.

9. A gutter having a body defining an interior space and a gutter guard which is pivotable between a closed position for preventing the flow of debris into said interior space and an open position to permit access to said interior space, said gutter body comprising longitudinally extending walls having top portions and a bottom connecting said walls;

said gutter guard having space-apart edge portions and having a middle portion separating said edge portions, at least one of said edge portions having longitudinally extending pivoting means and at least one of said edge portions having a pressure-sensitive adhesive on a bottom surface thereof, said edge portion having said pressure-sensitive adhesive contacting a top surface of one of said walls of said gutter body in said closed position, said middle portion of said gutter guard having passages to permit water to flow into the interior space of said gutter body.

* * * * *